US006367625B1

(12) United States Patent
Zobel

(10) Patent No.: US 6,367,625 B1
(45) Date of Patent: Apr. 9, 2002

(54) PROTECTIVE COVER FOR A GOLF BAG

(76) Inventor: Gordon J. Zobel, 1153 Dunston Dr., St. Louis, MO (US) 63146

( * ) Notice: Subject to any disclaimer, the term of this patent is extended or adjusted under 35 U.S.C. 154(b) by 0 days.

(21) Appl. No.: 09/642,389

(22) Filed: Aug. 18, 2000

Related U.S. Application Data

(60) Provisional application No. 60/150,860, filed on Aug. 26, 1999.

(51) Int. Cl.[7] ..... A65B 55/00

(52) U.S. Cl. ..... 206/315.4; 150/159

(58) Field of Search ..... 206/315.4, 315.2, 206/315.3, 315.7, 315.8; 150/159, 160; 224/901

(56) References Cited

U.S. PATENT DOCUMENTS

| | | | | |
|---|---|---|---|---|
| 936,698 | A | | 10/1909 | Breakspear |
| 948,347 | A | | 2/1910 | Schleicher |
| 1,119,508 | A | | 12/1914 | Headley |
| 1,149,028 | A | | 8/1915 | Chapman |
| 1,414,875 | A | | 5/1922 | Hanaford |
| 1,562,030 | A | | 11/1925 | Lawrence |
| 1,644,592 | A | | 10/1927 | Howland |
| 1,731,588 | A | | 10/1929 | Patterson |
| 1,770,060 | A | | 7/1930 | Barlow |
| 1,899,825 | A | | 2/1933 | Reach |
| 1,918,447 | A | | 7/1933 | Blatz |
| 2,267,226 | A | | 12/1941 | White |
| 2,340,896 | A | | 2/1944 | Neef, Jr. |
| 2,471,169 | A | | 5/1949 | Salzberg et al. |
| 2,509,195 | A | | 5/1950 | Barron |
| 2,844,275 | A | | 7/1958 | Keller |
| 3,059,681 | A | | 10/1962 | Lorbeski |
| 3,460,597 | A | | 8/1969 | Daly |
| 3,521,689 | A | | 7/1970 | Woods, Jr. |
| 3,913,648 | A | | 10/1975 | Sessler |
| 3,977,451 | A | | 8/1976 | Duba |
| 3,985,171 | A | | 10/1976 | Summers et al. |
| 4,078,594 | A | | 3/1978 | Oeckl |
| D256,293 | S | | 8/1980 | Edwards |
| 4,249,586 | A | | 2/1981 | Setani |
| 4,383,563 | A | | 5/1983 | Kirchhoff, Jr. |
| 4,442,937 | A | | 4/1984 | Delauder |
| 4,474,388 | A | * | 10/1984 | Wagner ..... 280/646 |
| 4,538,728 | A | | 9/1985 | Lewis |
| 4,860,889 | A | | 8/1989 | Lemieux et al. |
| 5,005,623 | A | | 4/1991 | Webster, Jr. |
| 5,024,259 | A | | 6/1991 | Treadway |
| 5,094,283 | A | | 3/1992 | Lawrence |
| 5,209,280 | A | | 5/1993 | Gevas |
| 5,220,950 | A | | 6/1993 | Cordasco |
| 5,383,505 | A | | 1/1995 | Cordasco, Jr. |
| 5,746,265 | A | * | 5/1998 | Hoyt et al. ..... 150/160 |
| 5,868,248 | A | * | 2/1999 | Joh ..... 206/315.6 |
| 6,192,950 | B1 | * | 2/2001 | Maeng ..... 150/160 |

* cited by examiner

*Primary Examiner*—Allan N. Shoap
*Assistant Examiner*—Lien Ngo
(74) *Attorney, Agent, or Firm*—Paul M Denk

(57) ABSTRACT

A protective cover for a golf bag having an opening and for holding golf clubs having different lengths is disclosed. The protective cover comprises a top adapted for enclosing the opening, a pair of support members connected to the top, each of the support members comprising a series of registration openings, a clamp associated with each of the supports for securing the support members to the opening of the golf bag, and a pair of guides positioned on each of the clamps, the guides for receiving the supports and allowing the supports to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

20 Claims, 2 Drawing Sheets

PROTECTIVE COVER FOR A GOLF BAG

This application claims benefit of the provisional application No. 60/150,860, filed on Aug. 26, 1999.

BACKGROUND OF THE INVENTION

This invention relates generally to a protective cover for a golf bag, and more particularly, to a protective cover for a golf bag which attaches to a golf bag for protecting any clubs contained therein during transit and storage.

Obviously, as is well known in the prior art, there have been many types of bags available for holding golf clubs. There are even some bags that include flexible coverings thereon, primarily for use for protecting the clubs from inclement weather, when encountered. One important consideration is to be able to protect the golf clubs stored in a golf bag during traveling or transit. For example, it is very important to be able to protect clubs from being damaged by airline baggage handlers. Perhaps the best device for this purpose is the rigid type carrying cases which surround the entire golf bag and clubs. However, these carrying cases are expensive, large, and bulky.

As can be seen in the various prior art patents, the patent to Salzberg et al., U.S. Pat. No. 2,471,169, shows a hood at the top of a particularly styled golf bag, and the hood appears to be fabricated of a flexible material.

The patent to Lorbeski, U.S. Pat. No. 3,059,681, shows a golf bag cover. But the cover appears to be designed for protecting the clubs from the elements, and not necessarily made of any rigid material, to provide protection upon travel.

U.S. Pat. No. 3,521,689 to Woods, Jr., shows a combination luggage bag and golf club cover. This cover appears to be fabricated of the more flexible type of material, which is opened through the manipulation of its zipper member.

The patent to Sessler, U.S. Pat. No. 3,913,648 shows golf bag cover that appears to be fabricated more of a canopy, and which may be of transparent material, even perhaps provide a base for advertising, but does not really describe exactly what type of material the canopy is fabricated from. This device does not appear to be satisfactory for transportation purposes, particularly since the clubs will be readily available for view, and means of interconnection does not appear to be that stable.

U.S. Pat. No. 3,941,398 to Nelson shows a golf club holder. It is not defined that the cover is formed of a molded article, which closes off the tope of the bag, but its only held in place by means of a fastener such as Velcro®, as can be noted. Thus, while this device may provide a little harder type of covering for a golf bag, it is not so stable that it could withstand its transit as through airline travel.

The patent to Setani, U.S. Pat. No. 4,249,586, shows a golf bag with what would appear to be a very flexible cover and held into closure by means of a zipper, which means it is constructed of a fabric type of material.

The patent to Treadway, U.S. Pat. No. 5,024,259, shows a golf club rain sack. This appears to be a flexible type of covering means, and which wraps about the upper end of the golf bag. This is not for transit purposes, although it may be described as a protective hood for golf clubs.

U.S. Pat. No. 5,094,283 to Lawrence, defines a golf club head cover having an article storage pocket. This cover is made of flexible material, since the pocket and upper lid are all held in closure by means of what appears to be Velcro®, although the patent describes such means of connection as a zipper.

The patent to Gevas, U.S. Pat. No. 5,209,280, describes a protective hood for golf clubs. This patent discloses the usage of a shell type device that curves around the bag collar and incorporates an upper pane. The entire device is held in position by means of a series of clips to provide a golf bag hood which can be readily attachable over the top of the golf bag to protect the protruding clubs against damage during rough handling that might occur in transit.

The patent to Cordasco, U.S. Pat. No. 5,220,950, shows another golf bag cover. This particular protective cover appears to be fabricated from a flexible material, and is actually fabricated in three sections, having a base portion, a baggy middle portion, and an upper cover.

The patent to Cordasco, Jr., U.S. Pat. No. 5,383,505, shows and describes a golf bag cover having a removable top that includes a base portion and a middle portion.

The present invention is designed to obviate and overcome many of the disadvantages and shortcomings associated with present protective devices for golf clubs. In particular, the present invention is a protective cover for a golf bag which may be used to easily protect golf clubs stored in a golf bag during transit. Moreover, the protective cover for a golf bag of the present invention is easier to use and handle than currently available protective covers for golf bags.

SUMMARY OF THE INVENTION

Regardless of the merits of the known art for protective equipment for closing over clubs in a golf bag, no such equipment has become the standard of the market for the purpose of club protection, and to provide such is a principal object of this invention.

The protective cover for a golf bag of the present invention is designed to work with existing conventional golf bags and golf bag covers. The protective device attaches to the golf bag in a manner that will not interfere with the fasteners used for the standard soft cover provided with most golf bags. The soft cover would be installed over the protective device in order not to interfere with the manufacturers intended use of the soft cover. The protective device is intended to be manufactured out of a hard durable material such as metal and/or plastic to provide optimum protection for the contents. Further, the invention is intended to be manufactured in different diameter widths to allow for the different size golf bags currently on the market with the most popular sizes ranging from 8" to 10" in diameter. The dome or coned shaped protective device is supported by four rigid supports that are adjustable in height. The supports fit into a uniquely designed clamp that slides onto the bag and is held in place by pressure through the clamp's design. The attachment clamp design allows the protective device to be easily removed without the need for tools or fasteners. The clamp device holds the vertical supports in place and allows the supports to be adjustable in height. By making the supports adjustable in height, the device will adjust to accommodate different length clubs and bag combinations. When the invention is not in use, it is designed to take up a minimal amount of space as opposed to the typical full sized hard carrying cases. If desired, the protective cover can be easily disassembled to make it even more compact for storage.

In one form of the present invention, a protective cover for a golf bag having an opening and for holding golf clubs having different lengths comprises a top adapted for enclosing the opening, a pair of support members connected to the top, each of the support members comprising a series of registration openings, a clamp associated with each of the supports for securing the support members to the opening of the golf bag, and a pair of guides positioned on each of the clamps, the guides for receiving the supports and allowing the supports to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

In another form of the present invention, a protective cover for a golf bag, the golf bag having an opening, the protective cover comprising a top adapted for enclosing the opening, a plurality of support members connected to the top, each of the support members comprising a series of registration openings, a clamp associated with each of the supports for securing the support members to the opening of the golf bag, and a pair of guides positioned on each of the clamps, the guides for receiving the supports and allowing the supports to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

In light of the foregoing comments, it will be recognized that a principal object of the present invention is to provide an improved protective cover for a golf bag.

Another object of the present invention is to provide a protective cover for a golf bag which is of simple construction and design and which can be easily employed with highly reliable results.

A further object of the present invention is to provide a protective cover for a golf bag that is adjustable to fit around a conventional golf bag independent of the dimensions or diameter of the golf bag.

A still further object of the present invention is to provide a protective cover for a golf bag which can be easily assembled for use and disassembled for compact storage.

Another object of the present invention is to provide a protective cover for a golf bag which can be adjusted to various heights to accommodate golf clubs having different lengths.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
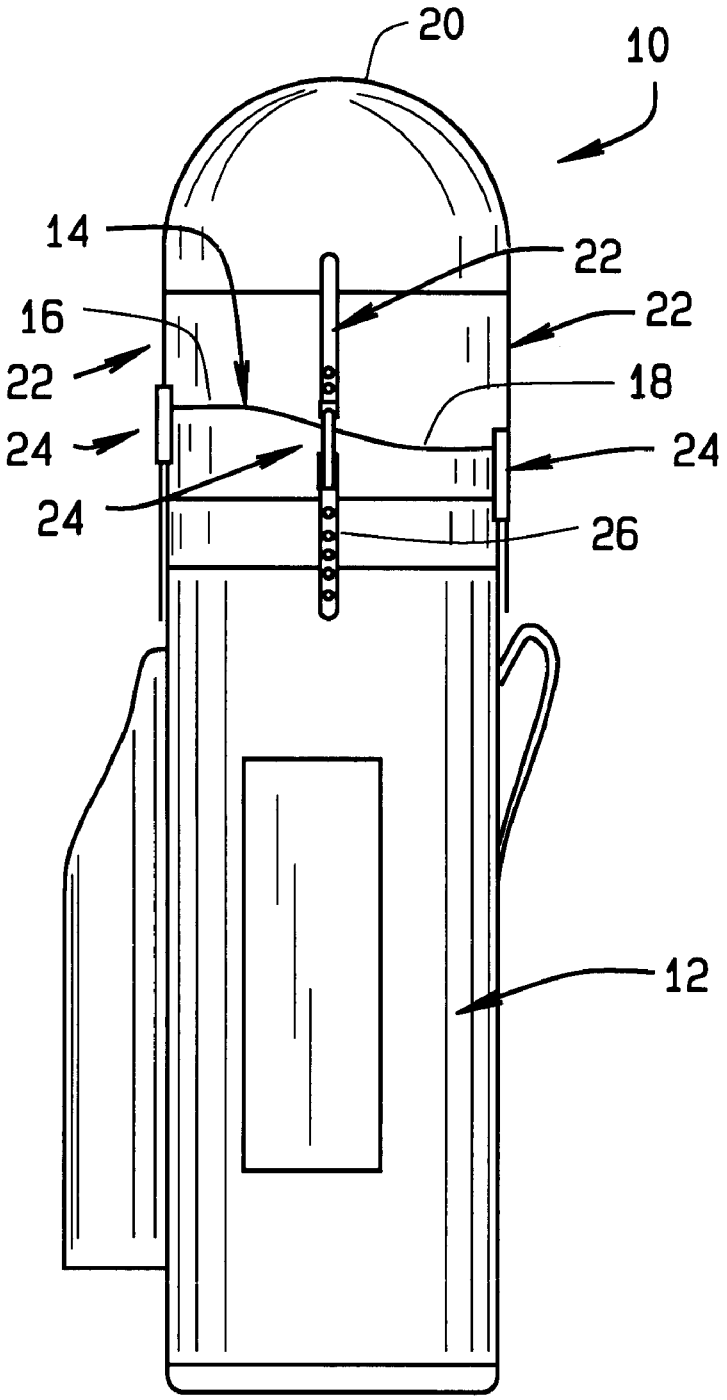
FIG. 1 is a perspective view of a preferred embodiment of a protective cover for a golf bag constructed according to the present invention.

Referring now to the drawings, wherein like numbers refer to like items, number 10 identifies a preferred embodiment of a protective cover for a golf bag 12 constructed according to the present invention. With reference now to FIG. 1, the protective cover 10 is adapted for use with a golf bag 12. The golf bag 12 has an opening 14 through which golf clubs of different lengths are placed for storage. The opening 14 is typically round in shape having a diameter ranging from 8" to 10". Although other shapes, such as ovals, and diameters are also found as the opening 14. Further, the opening 14 may formed such that one side 16 of the bag 12 which is higher than another side 18 of the bag 12. In this manner, the opening 14 of the bag 12 is uneven, however, it is also possible to have an opening which is even. The protective cover 10 comprises a cover or top 20 which may be dome or cone shaped and is constructed of a hard durable material such as metal or plastic. The top 20 is supported by a number of supports 22 which position the top 20 above the opening 14. Typically, four supports 22 may be used to support the top 20, however, two supports 22 may be sufficient. Associated with each of the supports 22 is a clamp device 24 which is used to secure the supports 22 to the opening 14 of the golf bag 12. Additionally, each of the supports 22 has a series of registration openings or holes 26 which run along the length of the supports 22.

Figure 2:
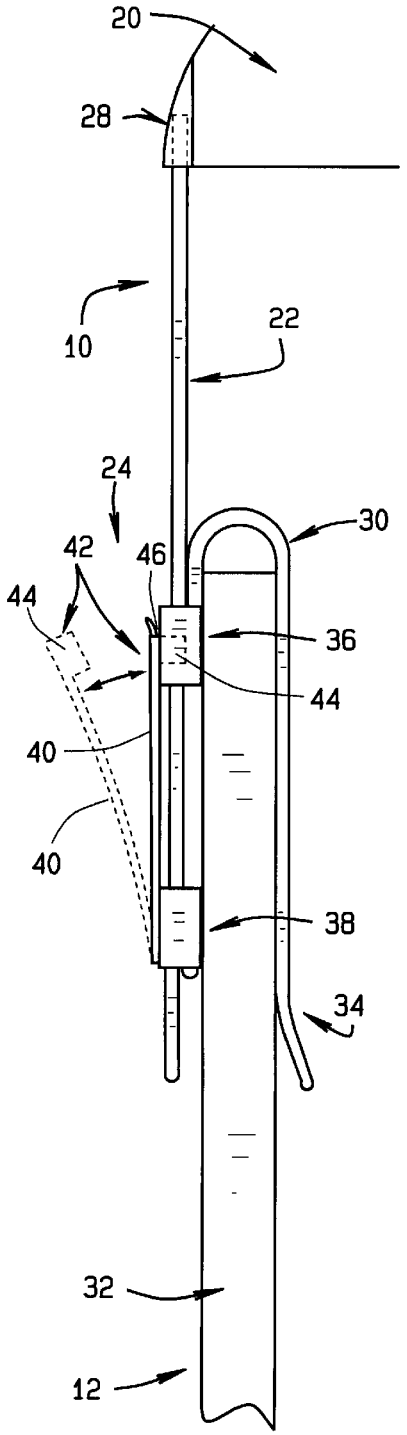
FIG. 2 is a partial side view of the protective cover for a golf bag.

With reference now to FIG. 2, a partial side view of the protective cover 10 is shown. The protective cover 10 comprises the top 20 having one of the supports 22 attached or inserted into a sleeve 28 formed in the top 20. The support 22 is further associated with the clamp device 24 for sliding engagement therein. The clamp device 24 comprises a clip 30 which is slightly less than the thickness of a side 32 of the golf bag 12. This allows the clip 30 to be inserted over the side 32 and to press against the side 32 of the bag 12 to hold the protective cover 10 in place. The clip 30 is generally U-shaped and has an interior end 34 which is flared outwardly from the side 32 of the bag 12. This provides for easily installation and alignment of the clip 30 when slipping the clip 30 over the side 32. Additionally, the flared end 34 helps to prevent tearing of the interior of the bag 12.

A pair of guides 36 and 38 are connected to the clip 30 and allow for sliding engagement of the support 22 relative to the clip 30. A retaining flange 40 is connected to the guide 38. The flange 40 has an upper portion 42 which has a tab or peg 44 which fits into an opening or hole 44 associated with the guide 36. In this manner, the retaining flange 40 is used to hold the support 22 in place once the required registration opening 26 has been lined up with the opening 44 in the guide 36. The flange 40 is flexible and may be removed from both of the openings 26 and 44 by applying an amount of pressure. The tab 44 being removed from the openings 26 and 44 is shown in phantom in FIG. 2. The flanges 40 serve to lock the supports 22 in place and to easily and quickly move the supports 22 relative to the clamp device 24.

Figure 3:
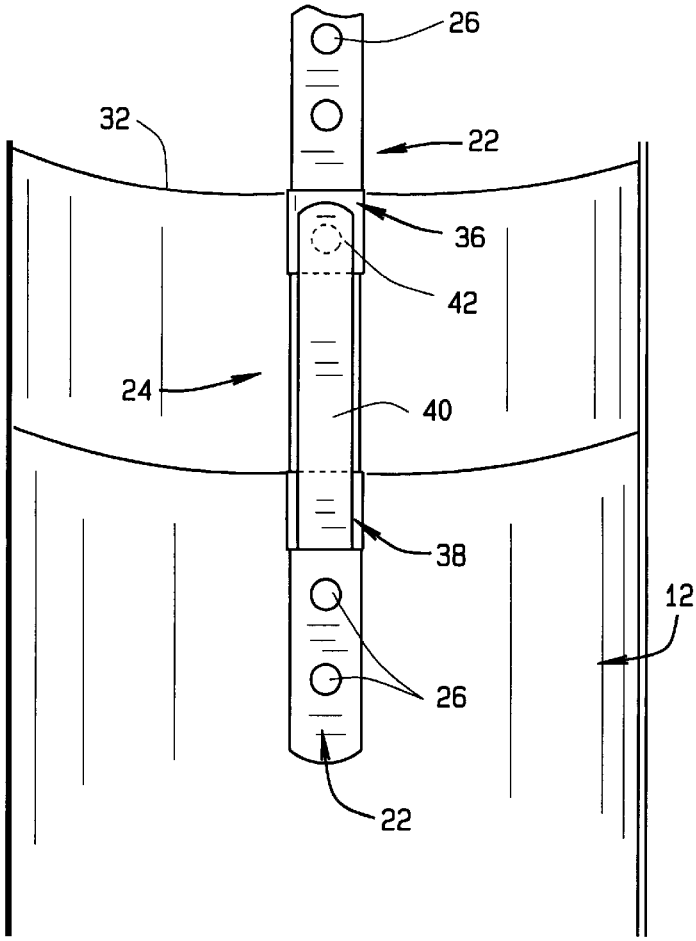
FIG. 3 is a partial front plan view of the protective cover for a golf bag constructed according to the present invention.

FIG. 3 illustrates a partial front plan view of the protective cover 10. The support 22 is shown to have the series of openings 26 which span a portion of the length of the support 22. Additionally, a portion of the support 22 is capable of extending below the lower guide 38. The lower guide 38 has the flexible flange 40 connected thereto and the upper portion 42 of the flange 40 is shown to be in alignment with or engagement with the hole 46 of the upper guide 36 and one of the openings 26 of the support 22. The support 22 is able to slide within the guides 36 and 38 and this allows the top 20 to be adjusted relative to the opening 14 of the golf bag 12.

The protective device 10 operates in the following manner. The clips 30, associated with each of the supports 22, are positioned over the side 32 of the opening 14 of the golf bag 12. The pressure from the clips 30 holds the device 10 onto the golf bag 12. With this force fit engagement there is no need for any other fastener type device. Once the clips 30 are in place, each of the supports 22 may be adjusted relative to the opening 14 in order for the top 20 to be level or to allow for clubs having different lengths. For example, as discussed above, if the opening 14 is uneven when side 16 is higher than side 18, each of the supports need to be adjusted. This is accomplished by moving each of the flanges 40 out of the openings 46 and moving the supports 22 until the required opening 26 is in position. Once in position, the flanges 40 are inserted into registration with the openings 26 and 46. Further, the protective device 10 may be disassembled when not in use. Disassembly may consist of removing the supports 22 from the top 20 in order for the most compact storage possible.

It should be recognized that the protective cover of the present invention can be constructed of various materials and can be assembled from separable components or formed as a unitary construction. Preferably, the protective cover for a golf bag will be of relatively lightweight and durable material so that it can be easily positioned, secured in place, and removed for storage.

From all that has been said, it will be clear that there has thus been shown and described herein a protective cover for a golf bag which fulfills the various objects and advantages sought therefor. It will become apparent to those skilled in the art, however, that many changes, modifications, variations, and other uses and applications of the subject protective cover for a golf bag are possible and contemplated. All changes, modifications, variations, and other uses and applications which do not depart from the spirit and scope of the invention are deemed to be covered by the invention, which is limited only by the claims which follow.

What is claimed is:

1. A protective cover for a golf bag, the golf bag having an opening and for holding golf clubs having different lengths, the protective cover comprising:

a top adapted for enclosing the opening;

a pair of support members connected to the top, each of the support members comprising a series of registration openings;

a clamp associated with each of the supports for securing the support members to the opening of the golf bag; and a pair of guides positioned on each of the clamps, the guides for receiving the supports and allowing the supports to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

2. The protective cover of claim 1 wherein each of the clamps comprises a clip having one end which is flared.

3. The protective cover of claim 2 wherein the clip is generally U-shaped.

4. The protective cover of claim 1 wherein the flange is flexible.

5. The protective cover of claim 1 wherein the top is dome shaped.

6. The protective cover of claim 1 wherein the top is made of a hard durable material.

7. The protective cover of claim 1 further comprising a third support member connected to the top with the third support member having a series of registration openings, a clamp associated with the third support member, and a pair of guides positioned on the clamp associated with the third support member, the guides for receiving the third support member and allowing the third support member to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

8. The protective cover of claim 1 wherein the support members may be disconnected from the top in order to store the protective cover in a compact state.

9. A protective cover for a golf bag, the golf bag having an opening, the protective cover comprising:

a top adapted for enclosing the opening;

a plurality of support members connected to the top, each of the support members comprising a series of registration openings;

a clamp associated with each of the supports for securing the support members to the opening of the golf bag; and a pair of guides positioned on each of the clamps, the guides for receiving the supports and allowing the supports to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

10. The protective cover of claim 9 wherein each of the clamps comprises a clip having one end which is flared.

11. The protective cover of claim 9 wherein the clip is generally U-shaped.

12. The protective cover of claim 9 wherein the flange is flexible.

13. The protective cover of claim 9 wherein the top is dome shaped.

14. The protective cover of claim 9 wherein the top is made of a hard durable material.

15. A protective cover for a golf bag, the golf bag having an opening, the protective cover comprising:

a top for covering the opening;

a pair of supports connected to the top, each of the supports comprising a series of registration openings;

a clamp device associated with each of the supports for securing the support members to the opening of the golf bag, the clamp device comprising a clip and a pair of guides connected to the clip, the guides for receiving the supports and allowing the supports to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf bag.

16. The protective cover of claim 15 further comprising a third support connected to the top with the third support having a series of registration openings, a clamp device associated with the third support for securing the third support to the opening of the golf bag, the clamp device comprising a clip and a pair of guides connected to the clip, the guides for receiving the third support and allowing the third support to slide therein, one of the guides having an opening which is aligned with the series of registration openings and the other guide having a flange having a tab at one end with the tab being adapted to be positioned into the opening in the one guide and one of the series of registration openings in order to adjust the height of the top relative to the opening of the golf.

17. The protective device of claim 15 wherein the clip has an end which is flared.

18. The protective device of claim 15 wherein the flange is flexible.

19. The protective device of claim 15 wherein the clip is generally U-shaped.

20. The protective device of claim 15 wherein the top is dome shaped.

* * * * *